United States Patent [19]

Docimo et al.

[11] 4,044,246

[45] Aug. 23, 1977

[54] CEILING MOUNTED LIGHT FIXTURE

[75] Inventors: Peter J. Docimo, Northridge; Paul L. Richey, Long Beach, both of Calif.

[73] Assignee: Marvin Electric Manufacturing Company, Los Angeles, Calif.

[21] Appl. No.: 713,665

[22] Filed: Aug. 12, 1976

[51] Int. Cl.[2] ..... F21S 1/06; F21S 3/06; F21S 13/06

[52] U.S. Cl. ..... 240/78 CF; 240/47; 240/78 DA

[58] Field of Search ..... 240/78 R, 47, 78 CF, 240/78 DA, 78 G, 149, 150

[56] References Cited

U.S. PATENT DOCUMENTS

| | | | |
|---|---|---|---|
| 1,770,986 | 7/1930 | Liagre | 240/78 CF UX |
| 2,638,531 | 5/1953 | Levy | 240/47 |
| 2,918,569 | 12/1959 | McCormack | 240/78 R X |

*Primary Examiner*—John Gonzales

*Attorney, Agent, or Firm*—Lyon & Lyon

[57] ABSTRACT

A light fixture is disclosed which is capable of being mounted flush with a ceiling without causing overheating of an associated junction box set into the ceiling immediately above the fixture. An upwardly and radially outwardly extending passageway is defined in the fixture between a ceiling cover plate having an upwardly and radially outwardly extending lower surface and a funnelform plate spaced below the ceiling cover plate. The funnelform plate has a center opening and light bulbs are disposed outwardly of the opening, beneath this plate. Passageways are dispose in an annular ring about the fixture and below the plate such that ambient air must pass across the lights to the center opening in the plate. The air may then pass through the upwardly and outwardly extending passageway as it is heated by the plate. The continual passage of air in this manner prevents overheating of the associated junction box located in the ceiling.

9 Claims, 3 Drawing Figures

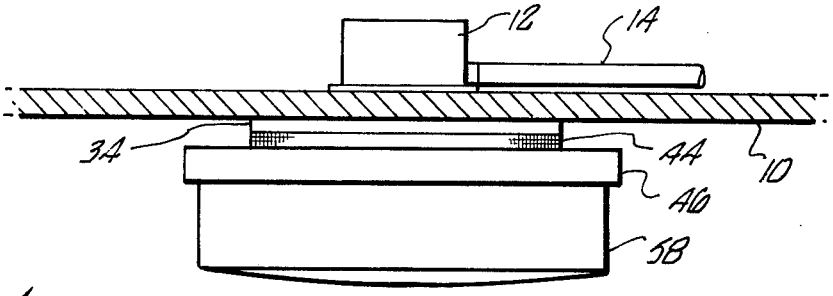
FIG. 1
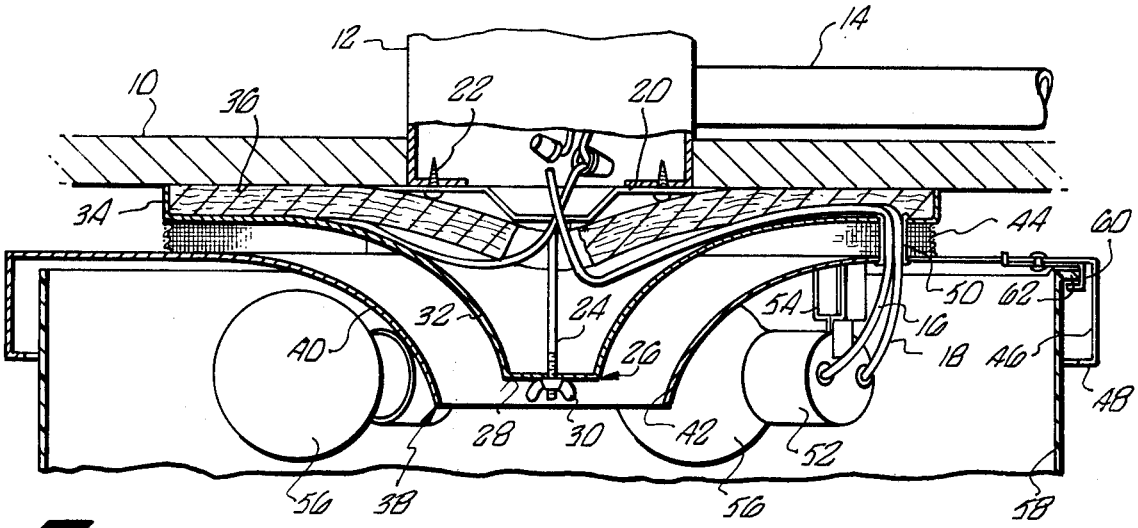
FIG. 3
FIG. 2
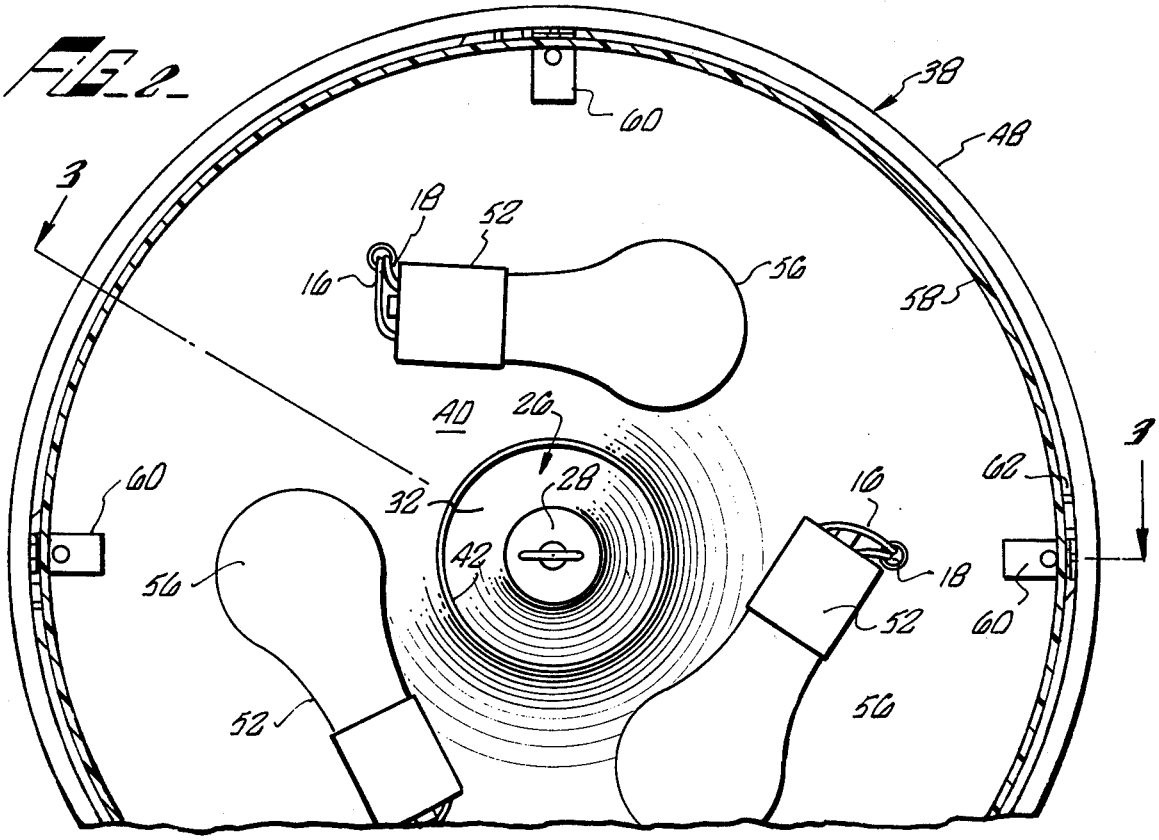

CEILING MOUNTED LIGHT FIXTURE

BACKGROUND OF THE INVENTION

The present invention is directed to a ceiling mounted light fixture. More specifically, the present invention is directed to a light fixture capable of being mounted flush on the ceiling without experiencing excessive heat transfer from the lights to the ceiling and junction box above the fixture.

A significant fire hazard has long been associated with ceiling mounted light fixtures currently available to the public. When such a light fixture experiences excessive heat transfer to the associated ceiling, a danger of fire exists, particularly in the junction boxes conventionally associated with such fixtures. Certain national standards have required that flush mounted light fixtures to be hung from ceilings not exceed a standard maximum rate of heat transfer to the associated ceiling. However, it has been found to be a common practice to simply employ the best available technology and then reduce the wattage of the light bulbs employed to reach an acceptable level. such an approach is perfectly acceptable except that the user is normally not aware of the danger and may inadvertently replace the acceptable lighting with light bulbs having higher, unacceptable wattages. The increased wattage results in a higher heat transfer to the ceiling and the associated junction box; and a fire may well result.

SUMMARY OF THE INVENTION

The present invention is directed to a ceiling mounted light fixture which may be mounted flush with the ceiling and yet provide sufficient heat insulation to allow use of any generally available light source which will fit in the fixture without danger of fire. This high resistence to heat transfer is provided, not by heat insulative materials, but rather by employing the air heated by the light source to keep the fixture cool. A ceiling cover plate having an upwardly and outwardly extending lower surface is combined with a second plate spaced below the ceiling cover plate positioned below the second plate and outwardly from the central opening therein. Ambient air is allowed to pass inwardly past the light bulbs and through the central opening in the second plate. This air is further heated by the second plate and cause to move by convection upwardly and outwardly beneath the ceiling cover plate. This induced flow of air prevents excessive temperatures within the light fixture and insulative materials positioned above the ceiling mounting assembly are able to handle the lower temperature.

Accordingly, it is an object of the present invention to provide an improved ceiling mounted light fixture.

It is another object of the present invention to provide a ceiling mounted light fixture which controls heat transfer to the ceiling and associated junction box.

It is a further object of the present invention to provide a ceiling mounted light fixture which employs the heated air generated within the fixture to maintain a low heat transfer rate to the adjacent celing.

Other and further objects and advantages will appear hereinafter.

BRIEF DESCRIPTION OF THE DRAWINGS

FIG. 1 is an elevation of a light fixture of the present invention with the associated ceiling in crosssection.

FIG. 2 is a cross-sectional bottom plan of a light fixture of the present invention with the cylindrical diffuous sectioned for clarity.

FIG. 3 is a cross-sectional elevation of a light fixture of the present invention taken along line 3—3 of FIG. 2.

DETAILED DESCRIPTION OF THE PREFERRED EMBODIMENT

Turining in detail to the drawings, and particularly FIG. 1, a light fixture of the present invention is illustrated as being mounted flush to the ceiling. The ceiling 10 is of normal composition and the unitary construction shown in the FIGS. is for simplicity of illustration. Mounted about the ceiling 10 is a junction box 12 to which power is supplied through a cable 14. At the junction box, the incoming wires are electrically terminated with the wire leads 16 and 18 associated with each socket. Certain codes have been established for building safety regarding heating of the junction box 12 from the depending light fixture. These regulations have been established because the heat generated by the associated fixture can cause degeneration of the insulation and the like which might ultimately result in fire. The fixture of the present invention is designed to eliminate the levels of heat transfer to the ceiling and junction box which could result in such a dangerous condition.

A mounting assembly is employed by the present invention to position the fixture flush on the ceiling. The mounting assembly includes a first mounting plate 20 which has a flat annular portion through which screws 22 or other conventional fasteners may be positioned to hold the plate rigidly against the ceiling. A center portion of the mounting plate 20 is depressed somewhat from the flat annular portion for convenience of assembly and attachment to the ceiling. This central portion includes a central hole for location of a long bolt 24 and passageways for the lead wires 16 and 18.

Depending from the first mounting plate 20 by means of the long bolt 24, a ceiling cover plate 26 is centrally positioned beneath the mounting assembly. In the preferred embodiment, the ceiling cover plate 26 includes a flat central portion 28 for receipt of the bolt 24 and an associated wing nut 30. Outwardly of the flat central portion 28, a complex curved portion 32 extends outwardly and upwardly to a circular perimeter. The complex curved portion 32 is defined by an arcuate element rotated about a vertical axis through the center of the ceiling cover plate 26. Conical and pyramidic shapes might also be employed in the present invention. At the circular periphery of the ceiling cover plate 26, a cylindrical flange 34 extends upwardly to meet the ceiling 10. Thus, the ceiling cover plate 26 provides a cover over the ceiling 10 and the junction box 12 immediately above the light fixture to prevent convection currents from conveying heat to the junction box area. The cavity formed between the ceiling cover plate 26 and the ceiling 10 forms an insulative air space and insulation 36 may be advantageously employed in this space.

A funnelform plate 38 is positioned beneath and spaced from the ceiling cover plate 26. The funnelform plate 38 has a similar complex curved portion 40 to that of the complex curved portion 32 of the ceiling cover plate 26. However, the complex curved portion 40 of the funnelform plate 38 is larger such that when positioned, a radially outwardly and upwardly extending passageway is formed between the two plates. The funnelform plate 38 has a central opening 42 which serves as an inlet to receive heated air which can then pass upwardly and outwardly through the passageway between the plates. A cylindrical screen 44 is positioned across the passageway between the ceiling cover plate 26 and the funnelform plate 38 simply to prevent bugs from entering the light fixture.

Outwardly of the cylindrical screen 44, the funnelform plate 38 extends radially outwardly to a cylindrical, depending flange 46 which covers the upper end of the diffuser. A small inwardly extending flange 48 may also be formed in the funnelform plate 38 such that a raw edge of the funnelform plate 38 is not exposed at the lower end of the cylindrical flange 46.

To hold the ceiling cover plate 26 and the funnelform plate 38 in spaced relationship, three hollow rivets 50 are uniformly spaced about the fixture. The hollow rivets 50 are swaged outwardly at either end to prevent separation of the ceiling cover plate 26 and the funnelform plate 38. The rivets 50 are hollow to provide passageways for the lead wires 16 and 18 through both plates and into the cavity between the ceiling 10 and the ceiling cover plate 26. The rivets 50 are sized to prevent excessive access space through the plates and are also positioned outwardly near the periphery of the ceiling cover plate 26 so that no major flow of hot air will be experienced into the cavity between the ceiling 10 and the ceiling cover plate 26.

Light sockets 52 are suspended from the funnelform plate 38 by conventional brackets 54. The light sockets 52 are positioned beneath the funnelform plate 38 such that light bulbs 56 will be placed outwardly of the central opening 42 in the funnelform plate 38 and will be spaced from the funnelform plate 38 itself. The light bulbs 56 are shown to be conventional incandescent lamps. However, the present invention contemplates all light bulbs which give off radiant energy and would be operable with the present fixture regardless of their configuration. The funnelform plate 38 is shown to be metallic in nature but may be of any convenient material which will not melt or otherwise deteriorate during operation of the fixture.

A cylindrical diffuser 58 is associated with the funnelform plate 38 at brackets 60. Four such brackets are provided and are associated with the cylindrical diffuser 58 by four outwardly extending flanges 62. The remainder of the upper edge of the cylindrical diffuser 58 is spaced from the funnelform plate 38 such than an annular passageway exists between the diffuser 58 and the funnelform plate 38 except at the four brackets 60. The diffuser 58 is also spaced inwardly from the flange 48 to create a continuous passageway from outside of the light fixture, inwardly around the upper edge of the diffuser 58, past the lights to the central opening 42.

The light fixture employs the heat generated by the light bulbs 56 to prevent excessive build--up of heat in the junction box 12. The air within the enclosure defined by the diffuser 58 and the funnelform plate 38 is heated by the light bulbs 56. This heated air will then move by convection through the radially outwardly and upwardly extending passageway between the ceiling cover plate 26 and the funnelform plate 38. The upwardly extending passageway will also be heated by conduction of heat from the light bulbs through the funnelform plate 38 as air moves upwardly and outwardly through is passageway; cool air is brought in at the annular opening between the diffuser 58 and the funnelform plate 38. The established convection currents will then prevent an excessive build-up of heat within the light fixture and thus cooperate with the insulative cavity formed between the ceiling cover plate 26 and the ceiling 10 to eliminate overheating of the junction box 12.

Thus, an improved ceiling mounted light fixture is disclosed in the present invention which prevents overheating of the associated junction box and adjacent ceiling. While embodiments and applications of this invention have been shown and described, it would be apparent to those skilled in the art that many more modifications are possible without departing from the inventive concepts herein described. The invention, therefore, is not to be restricted except by the spirit of the appended claims.

What is claimed is:

1. A light fixture to be mounted to a ceiling, comprising a ceiling cover plate having an underside extending upwardly and outwardly from a central position to meet the ceiling when positioned thereon;

a second plate extending outwardly from a central position beneath said ceiling cover plate, said second plate having an opening therethrough;

fastening means extending between said ceiling cover plate and said second plate to hold said second plate spaced from said ceiling cover plate to define and upwardly and radially outwardly extending passageway;

light socket means positoned below said second plate outwardly of said opening.

2. The light fixture of claim 1 further comprising inlet passageway means spaced from said light socket means beneath said second plate such that ambient air may flow past said light socket means to said opening.

3. The light fixture of claim 1 wherein said second plate extends upwardly and radially outwardly in a funnelform shape.

4. The light fixture of claim 1 further including a mounting assembly, said mounting assembly being attachable to the ceiling, said ceiling cover plate being capable of fixedly depending from said mounting assembly.

5. The light fixture of claim 1 further including a cover diffuser depending from near said second plate and an inlet passageway means spaced from said light socket means between said second plate and said diffuser such that ambient air may flow past said light socket means to said opening.

6. The light fixture of claim 1 wherein said ceiling cover plate defines a cavity between said ceiling cover plate and said ceiling when said ceiling cover plate is positioned against said ceiling.

7. The light fixture of claim 6 further including insulative material positioned in said cavity.

8. The light fixture of claim 1 wherein said opening is centrally located through said second plate.

9. A light fixture to be mounted to a ceiling, comprising a mounting assembly, said mounting assembly being attachable to the ceiling;

a ceiling cover plate capable of being fixed beneath said mounting assembly and having an underside extending upwardly and outwardly from a central positon when fixed to said mounting assembly;

a second plate extending upwardly and outwardly from a central position beneath said ceiling cover plate, said second plate having an opening through the center thereof;

fastening means extending between said ceiling cover plate and said second plate to hold said second plate spaced from said ceiling cover plate to define an upwardly and radially outwardly extending passageway;

light socket means positioned below said second plate outwardly of said opening;

inlet passageway means spaced from said light socket means beneath said second plate such that ambient air may flow past said light socket means to said opening.

* * * * *

UNITED STATES PATENT OFFICE

CERTIFICATE OF CORRECTION

PATENT NO. : 4,044,246

DATED : August 23, 1977

INVENTOR(S) : Peter J. Docimo and Paul L. Richey

It is certified that error appears in the above-identified patent and that said Letters Patent are hereby corrected as shown below:

In Col. 4, line 26 please delete

--and-- and insert "an" therefor.

Signed and Sealed this

*Twenty-second* Day of *November 1977*

[SEAL]

*Attest:*

RUTH C. MASON
*Attesting Officer*

LUTRELLE F. PARKER
*Acting Commissioner of Patents and Trademarks*